US005458033A

United States Patent [19]

Wierschke

[11] Patent Number: 5,458,033

[45] Date of Patent: Oct. 17, 1995

[54] TRIM ELIMINATOR FOR LOG SAW

[75] Inventor: Larry D. Wierschke, Green Bay, Wis.

[73] Assignee: Paper Converting Machine Company, Green Bay, Wis.

[21] Appl. No.: 175,148

[22] Filed: Dec. 29, 1993

[51] Int. Cl.[6] ..... B26D 7/18

[52] U.S. Cl. ..... 83/104; 83/152; 198/471.1

[58] Field of Search ..... 83/100, 104, 151, 83/152, 155.1, 329; 198/428, 471.1

[56] References Cited

U.S. PATENT DOCUMENTS

| | | | |
|---|---|---|---|
| Re. 28,353 | 9/1972 | Nystrand et al. | 242/527.1 |
| Re. 30,598 | 5/1981 | Spencer | 83/14 |
| 4,462,287 | 7/1984 | Weis et al. | 83/104 |
| 4,773,522 | 9/1988 | Lenhart | 198/428 X |
| 4,828,195 | 5/1989 | Hertel et al. | 242/521 |
| 4,977,803 | 12/1990 | Blom | 83/23 |

*Primary Examiner*—Rinaldi I. Rada
*Assistant Examiner*—Raymond D. Woods
*Attorney, Agent, or Firm*—Tilton, Fallon, Lungmus & Chestnut

[57] ABSTRACT

Trim eliminator for log saw and method in connection with the rewinding of webs into logs and rolls or toilet tissue and toweling wherein two independently adjustable suspensions systems are employed for each log/roll lane so as to suspend rolls over a cull area but not the trim annuli generated from cutting the log ends.

14 Claims, 4 Drawing Sheets

$A_U$
$A_D$
$R_D$
$R_U$
14
16
17
29
23
R'

TRIM ELIMINATOR FOR LOG SAW

BACKGROUND AND SUMMARY OF INVENTION

This invention relates to a trim eliminator for a log saw and method and, more particularly, to a trim eliminator which can be adjusted quickly to compensate for changes in log length, roll length, trim size and/or roll diameter.

In the production of such consumable products as toilet tissue and kitchen toweling, jumbo sized parent rolls from a paper machine are transferred to a converting area where they are "rewound". The rewinding involves unwinding the parent rolls, usually transversely perforating the web therefrom, and then rewinding the web into a log having the diameter of a retail sized roll. Illustrative of rewinders are co-owned U.S. Pat. Nos. RE. 28,353 and 4,828,195 dealing respectively with the center winding type and the surface winding type of rewinder. The output of these machines normally is a log having a length equal to the width of the web being unwound from the parent roll.

Thereafter, this log is subjected to transverse cutting by a log saw so as to develop a plurality of retail sized rolls and to end trim annuli. Illustrative of a log saw is co-owned U.S. Pat. No. RE. 30,598. The annuli at the log ends are necessarily present because the width of the sheet or web from the parent roll cannot be exactly an even multiple of the number of rolls to be derived therefrom. A certain amount of "trim" is always provided so as to make sure that the end rolls, i.e., the rolls from each side of the web, have clean, flat ends.

The trim annuli have been disposed of over the years in a number of ways. The first ways used belt and rail systems that allowed the trims to fall through the rails based on the length to width ratio of the cut rolls. This type removed a high percentage of the trim annuli but was not perfect. In the early days, machine speeds were slower and roll wrapping less automatic so the operation was more tolerant of trims which could be removed from the operating area in other ways.

As wrapping equipment became fully automated, producers could no longer tolerate any trims getting past the trim eliminator area of the log saw. In recent years, the trim eliminator made use of an overhead chain conveyor with fingers on a certain pitch (i.e., spacings) that grabbed and controlled the rolls coming out of the saw and conveyed them over a wide opening over a cull conveyor. The controlled rolls were then delivered to a secondary roll transport conveyor for direct feed into a downstream wrapper. Currently, two methods are employed to separate the trims from the good rolls. First, the finger-equipped overhead conveyor has fingers missing in the area corresponding to known trim locations and the trim falls off into the cull unit. Second, all fingers are present but the fingers that would have the opportunity to grab trims are opened over the cull area.

There are shortcomings of the current systems in that fingers are susceptible to breakage during jams, the fingers and cam operators are considered a high maintenance item, the finger roll diameter range is not always adequate and the fingers' constant pitch (spacing) requires that the incoming rolls are also on a constant pitch. This means that if the cutoff length is changed (a new roll pitch or length), the roll pitch between logs also changes making the fingers end up out of phase with the rolls. Related to this type of trim handling mechanism is co-owned U.S. Pat. No. 4,977,803. The problem of phase differences because of the change in roll and/or log lengths has been addressed with servo drives on the finger conveyor but this has still not provided the solution desired by producers of toilet tissue and toweling.

According to the invention, a novel type of roll suspension means is provided consisting of two suspension conveyor systems for each log lane which can be readily "phased" to compensate for changes in roll diameter and/or the length of the roll, trim and log. The term log as used herein refers not only to convolutely wound webs but also to any elongated lengths of multi-ply material such as interfolded facial tissues which require end trimming when transversely severed to provide shorter lengths.

More particularly, the invention provides a method and apparatus for handling rolls and trim annuli resulting from transversely severing logs of convolutely wound web material such as toilet tissue and kitchen toweling wherein each log has an upstream end and a downstream end. The apparatus includes a frame, trough means on the frame defining a horizontal path also having upstream and downstream ends for supporting first the logs and thereafter the rolls. Pusher means are operably associated with the trough means for engaging the upstream end of a log to advance the log toward the downstream end of said path. Blade means are movably mounted on the frame for transversely severing each log into a plurality of retail-size rolls and upstream and downstream trim annuli.

The trough means adjacent the path downstream end is equipped with means for opening the trough to remove the support from the retail-size rolls and trim annuli with the opening means having a horizontal length sufficient to allow a trim annulus to fall through the trough means More particularly, the opening means has a horizontal length sufficient to open at least one cut roll length.

There are first means mounted on the frame above the opening means for suspending the first log upstream roll and second means above the opening for suspending the following log downstream roll independently of the first log upstream roll, neither of the first and second means being operative to suspend the trim annuli whereby the trim annuli are adapted to fall out of the path.

In the preferred embodiment, the roll suspending means includes a pair of belt systems, each equipped with foraminous pad portions which are subjected to vacuum so as to support at least the upstream roll of a given log and at least the downstream roll of a following log. Means are also provided for changing the relationship of one pad relative to the other whenever there is a "length" change, i.e., a change in length of the roll, the log and/or the trim annulus.

Other objects and advantages of the invention may be seen in the details of construction set down in the ensuing specification.

BRIEF DESCRIPTION OF DRAWING

The invention is described in conjunction with the accompanying drawing, in which—

DETAILED DESCRIPTION

Figure 1:
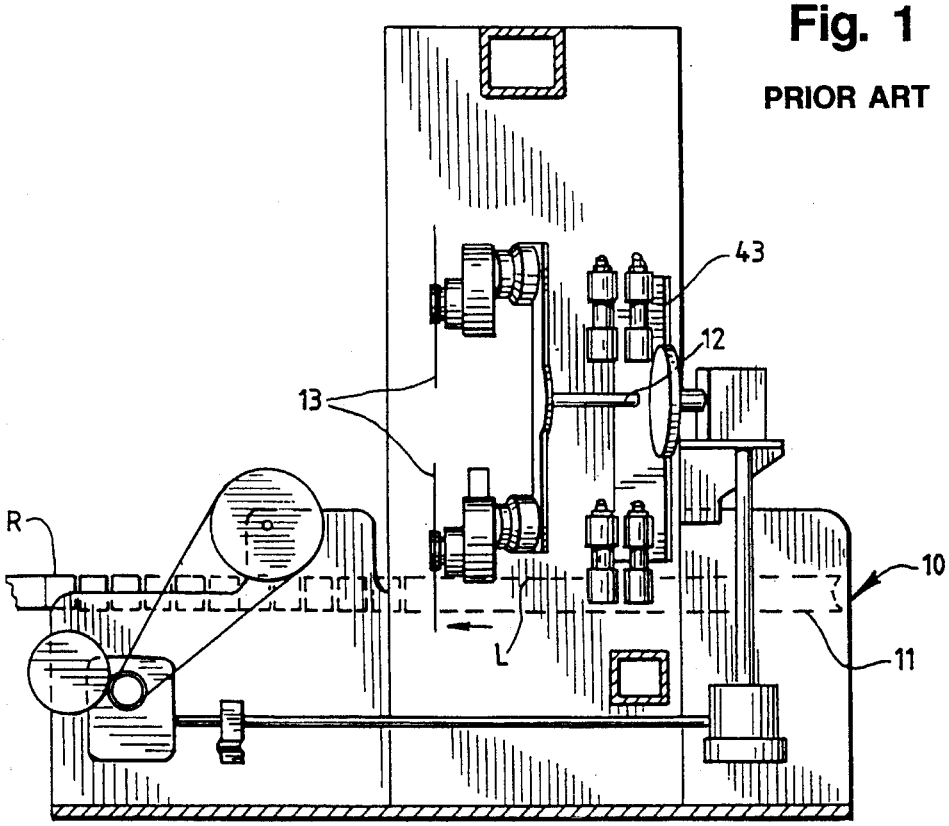
Fig. 1 PRIOR ART
FIG. 1 is a side elevational view, essentially schematic, of a log saw of the type shown and described in co-owned U.S. Pat. RE. 30,598.

In the illustration given and with reference first to FIG. 1, the numeral 10 designates generally a frame of a log saw which is equipped with a horizontally extending log and roll mover 11 (shown schematically). Arranged on a rotating shaft 12 are blades or discs 13 which orbit so as to transversely sever the log L into identical rolls R. The details of the log saw constitute no part of this invention but may be found in the above mentioned U.S. Pat. No. RE. 30,598.

As the rolls R are developed (now referring to FIG. 2), they are moved or conveyed horizontally from an upstream end to a downstream end by means of the mover 11. More particularly, the mover 11 includes trough means in the form of supporting rails as at 14 (see the right central portion of FIG. 2). These are fixed rails—in contrast to the pivotally mounted rails generally designated 15 which extend over the annulus cull opening 16. Advancing the rolls R along the rails 14 is a series of pusher mechanisms 17 which are mounted on a continuous chain 18 (shown only schematically in FIG. 2). The pusher mechanisms 17 extend up through the spacing between the rails 14 and are used to advance first the log at the extreme upstream end of the horizontal path and later (after being sawed), the pushers push the rolls R toward the left end or downstream end of the path.

Figure 4:
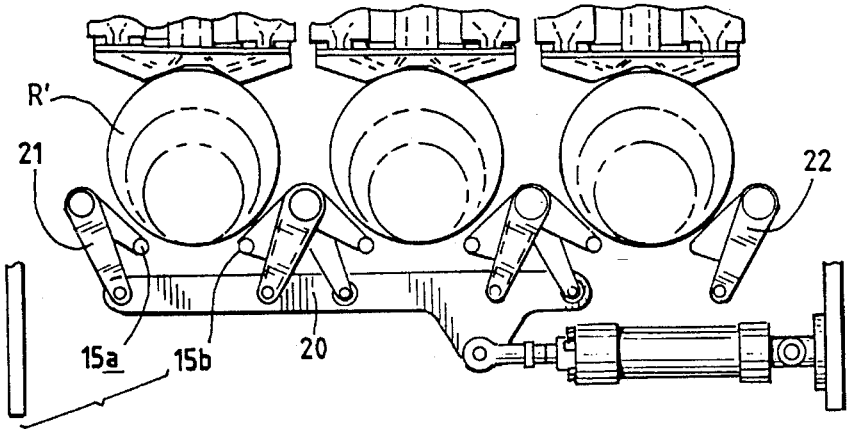
FIG. 4 is a fragmentary end elevational view showing the trough means in roll supporting condition.
Figure 5:
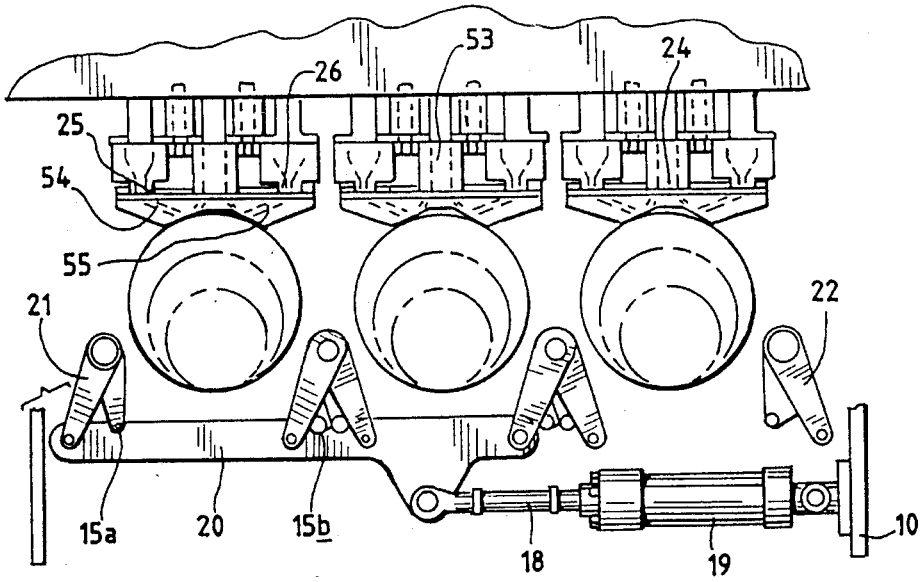
FIG. 5 is a view similar to FIG. 4 but showing the rails which provide the portion of the trough means over the opening means in "non-supporting" condition.

The normal condition of the rails 15 over the gap or opening 16 is seen in FIG. 4. Comparing FIGS. 2 and 4 the cut rolls $R_U$ and $R_D$ are supported over the opening 16 by means of left hand rail 15*a* and right hand rail 15*b*. The several rolls R' illustrated show different diameter rolls. In FIG. 5, the rails 15*a* and 15*b* are shown in open condition. This is done relative to the rails 15*a* by extending the rod 18 of fluid pressure cylinder 19 which is affixed to the frame 10.

The rod 18 is pivotally connected to a linkage 20 which in turn pivotally carries an arm 21 for each left hand rail 15*a*. A similar cylinder rod and linkage is provided for the arm 22 associated with each right hand rail 15*b*.

Figure 2:
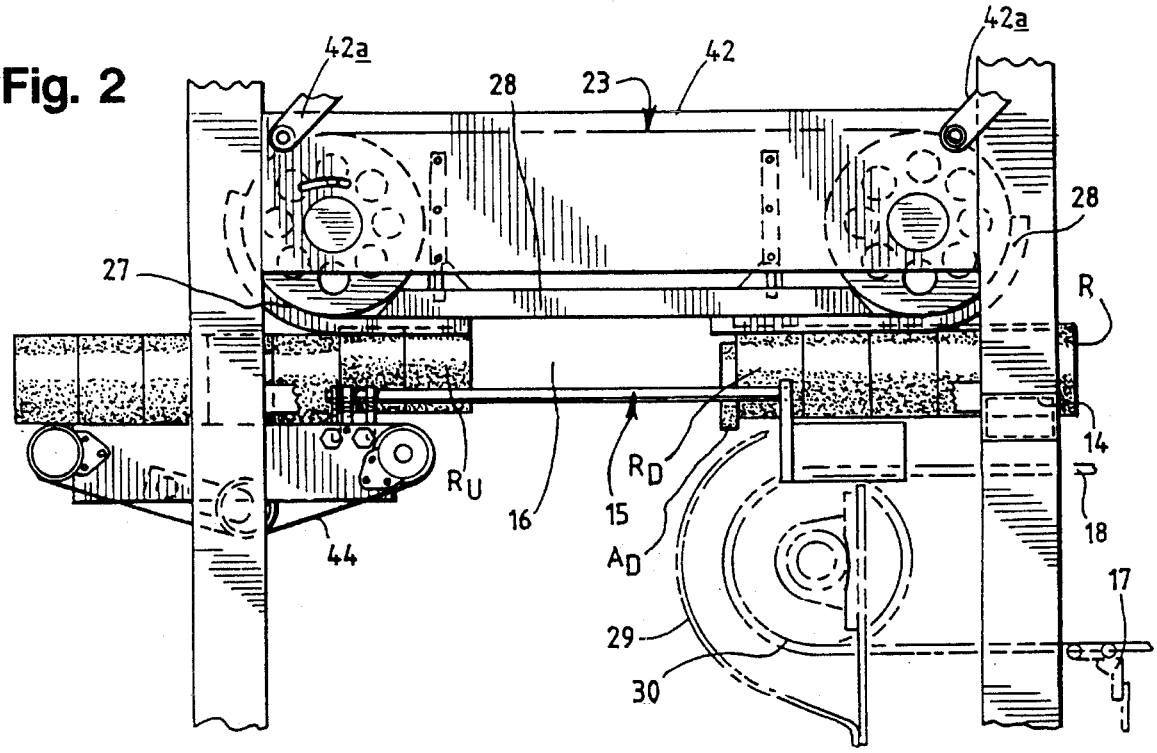
FIG. 2 is a fragmentary side elevational view, partially in section, of the inventive trim eliminator portion of a log saw system.
Figure 7:
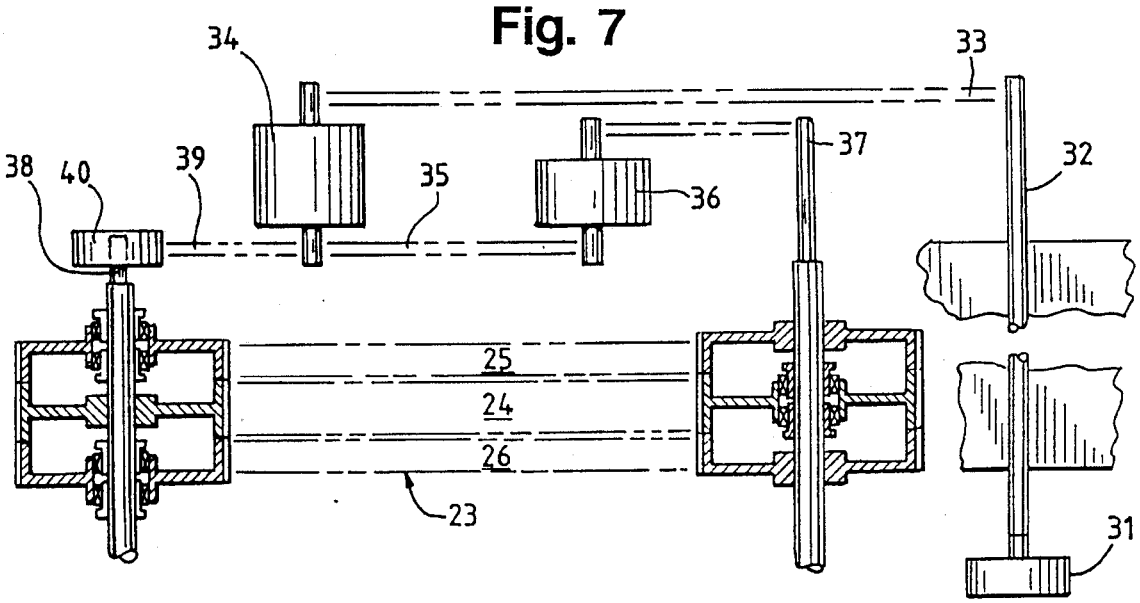
FIG. 7 is a top plan view, essentially schematic, of the layout of the trim eliminator of the invention and associated control mechanisms.

The signal for opening the rails 15*a* and 15*b* comes from a master controller to be described in conjunction with FIG. 7 and which pivots the rails 15*a* and 15*b* out of roll-carrying condition when suspension means generally designated 23 is actuated to suspend rolls over the opening 16—see also FIG. 2. It is in the area of the opening 16 in which the trim annuli fall while the rolls R are suspended above the opening by means of a suspension system or conveyor generally designated 23—see FIG. 8I. The suspension system 23, in the illustration given, includes two continuous belt or chain arrangements in side-by-side relation. This can be appreciated from FIG. 6 where a first system is designated 24 and a second system made up of belts 25 and 26. In other words, the second system includes a pair of belts 25 and 26 which flank the single belt 24 of the first system.

The belt system arrangement is not critical in the sense that a specific system must be outside the other because each carries a vacuum pad which contacts and suspends the top of a roll in a given lane—so the relationship of systems could be reversed. For example, in FIG. 2, the first belt system 24 is equipped with a foraminous pad 27 which is subjected to vacuum from a vacuum box or chamber. The purpose of the first belt system 24 and its pad 27 is to support at least the trailing or upstream roll $R_U$ as that roll travels over the opening 16.

Figure 3:
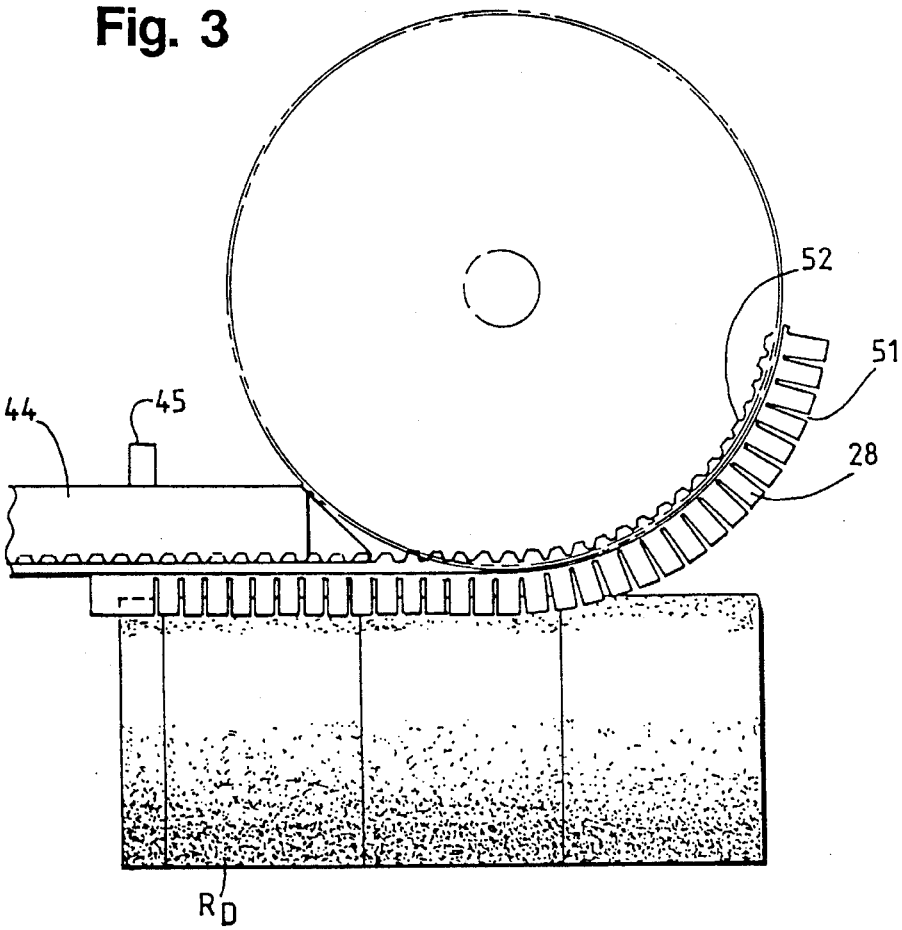
FIG. 3 is an enlarged fragmentary side elevational view of a right hand portion of FIG. 2.

The second belt system which includes the spaced apart belts 25, 26 are equipped with a foraminous pad 28—also see FIG. 3. The pad 28 is spaced longitudinally from the pad 27 so it also can contact the upper surface of a different roll in the same lane, more particularly, the leading or downstream roll $R_D$ of a following log.

Summary of Operation

As logs L are cut into retail-length rolls R, they come under the pad 28 which is effective to suspend at least the downstream or leading roll $R_D$ as it passes over the opening 16. The pad 28 terminates at its downstream end at the downstream end of the roll $R_D$, i.e., it terminates short of the annulus $A_D$ in FIG. 2. This results in the annulus $A_D$ dropping vertically downwards to a trim disposal (not shown). In the same fashion, the pad 27 starts at the upstream end of the extreme upstream roll $R_U$ of a preceding log. Thus it does not contact the upstream trim annulus—identified as $A_U$ in FIG. 8F. This upstream annulus is not shown in FIG. 2 because it has already fallen into the opening 16. In other words, at any particular time, normally it is difficult to see more than one annulus dropping into the opening 16. This can be appreciated from the sequence of views shown in FIG. 8F.

Figures 8A, 8B, 8C, 8D, 8E, 8F, 8G, 8H, 8I, 8J, 8K, 8L:
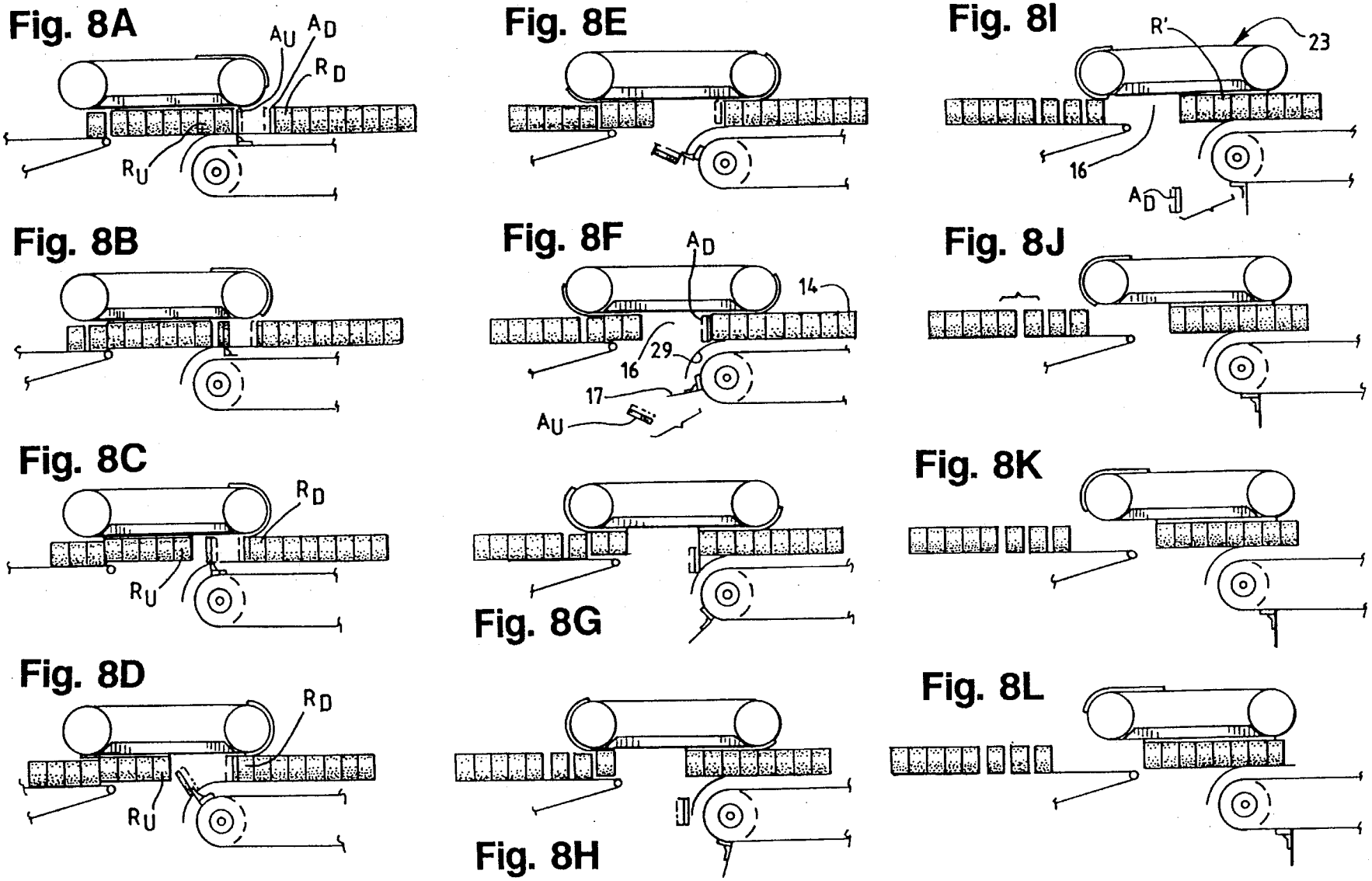
FIGS. 8A–8L are a series of side elevational views somewhat analogous to the view of FIG. 2 and which show the sequence of roll movement through the trim eliminator.

In the view FIG. 8F, the trim annulus from the upstream end of a first log is designated $A_U$ and is seen to be a substantial distance below the rail 14. The trim annulus from the downstream end of the following log is designated $A_D$ and is just about to fall away from the rail 14 and onto the guard 29 for chain sprocket 30 for chain 18, see also FIG. 2.

The important advantage of the invention is the ability to quickly accommodate the trim eliminator to a change in operation, viz., particular change in length of any or all of logs, rolls and trim annuli. This is done by changing the phase of the systems of belts 24 and 25, 26. More particularly, this is done by advancing or retarding the pad 28 relative to the pad 27 or to the pusher 17, i.e., phasing.

System Phasing

Reference is now made to FIG. 7 where the numeral 31 (lower right hand portion) designates a servo drive for the drive shaft 32 of the mover 11, i.e., the infeed conveyor for the logs and rolls. This is tied (mechanically or electrically or both) by line 33 to the master phaser 34. This is the master phaser for the entire vacuum belt system and is controlled by a stepper motor. However, the stepper can be eliminated and replaced with a hand knob if push-button adjustment is not required. This phaser 34 will only need to be used if the rear trim length is varied. A suitable phaser 34 can be obtained from Candy Controls as Model DIFF 7.

The output of the phaser 34 is communicated by line 35 to a slave phaser 36 which controls the belt system 25, 26 via the drive shaft 37. A suitable phaser 36 can be obtained from Candy Controls as Model DIFF 2. As illustrated in FIG. 7, the coupling from slave phaser 36 is to the drive shaft and, in turn, to the pulleys associated with the belt system 25, 26. The belts 25 and 26 are entrained in the upstream driven pulleys (at the right in FIG. 7) and also over the downstream idler pulleys mounted on shaft 38 at the downstream end of the suspension system 23.

The phaser 36 operates on the rolls derived from the leading end of the log and adjusts the vacuum belt relationship to the front or downstream end of the log as the log length or the first cut position changes, viz., difference in trim length or roll length.

The master phaser 34 is also coupled via line 39 to a mechanical advancer 40 which, in turn, controls the shaft 38. The shaft 38, in addition to rotatably supporting the idler pulleys of the belts 25, 26, has fixed thereto a driven pulley for the first belt system 24. Correspondingly, the drive shaft 32 for the second belt system 25, 26 has rotatably supported thereon the idler pulley for the first belt system 24.

Normally, when there is a change in the length of any of the log, roll or trim, a change is introduced into the master phaser 34 which then communicates this to the slave phaser 36 and thence to the drive 37 for the second belt system 25, 26.

To make the drive arrangement easiest, the length of each belt system 24 or 25, 26 should equal the saw infeed conveyor flight length, i.e., the distance between adjacent pushers 17. This then allows exact timing repeat and a common drive from one to the other. Although, if lengths do not match, a servo motor system could make up for this difference. Since each conveyor can share a common drive, this means that the infeed conveyor does not require a constant velocity. The saw infeed conveyor or mover 11 could use velocity changes between logs or rolls and the trim eliminator will just follow along by matching velocity for velocity.

Mechanical Advancer

This has been referred to previously as at 40 in the upper left hand portion of FIG. 7. Once each cycle this device operates to speed up the advance of belt system 24 carrying the last rolls of a log away from the pusher 17 in order for the pusher to swing downwardly. This can be appreciated from a consideration of the sequence of views in FIG. 8 beginning at FIG. 8D. There, the spacing between the downstream roll $R_D$ of a following log from the upstream roll $R_U$ is seen to be greater than that in the previous views FIGS. 8A–8C and continues to increase to permit the pusher 17 to pass by the trailing end of the upstream roll $R_U$ as seen in sequence view FIG. 8E.

This unit 40 then returns the belt 24 to its normal state or phase later in the cycle when the roll transfers are complete and the advancement to packaging is undertaken by belt 41 (see FIG. 2). For example, the mechanical advancer 45 can be a rotary pneumatic device rephasing the belt system 29 70° back and forth each cycle obtainable from Micro Precision, Inc. as Model SS-3V.

Roll Diameter Adjustment

Referring now to FIG. 2, the numeral 42 designates a subframe which is positionably mounted on the main frame 10. This permits raising or lowering of the entire suspension system 23 for changes in roll diameter. For example, as can be appreciated from the extreme right hand showing in FIG. 6, the largest size log or roll is being accommodated which normally is of a diameter of 6.50". The smallest size illustrated has a 3.54" diameter while the intermediate size has a 5.0". diameter. Correspondingly, screw jacks (not shown) are employed to raise and lower the skew plate 43 (see FIG. 1) relative to the frame 10 as at 42*a*.

Vacuum System Details

As pointed out previously, it is also feasible to replace the vacuum aspect of this invention with random mechanical fingers in a short area on each of the two belt or chain systems per lane and still retain the new quick product variability that this invention provides. However, the use of mechanical fingers deprives the user of the benefit of reduced maintenance that vacuum offers, particularly insofar as moving parts are concerned.

Figure 6:
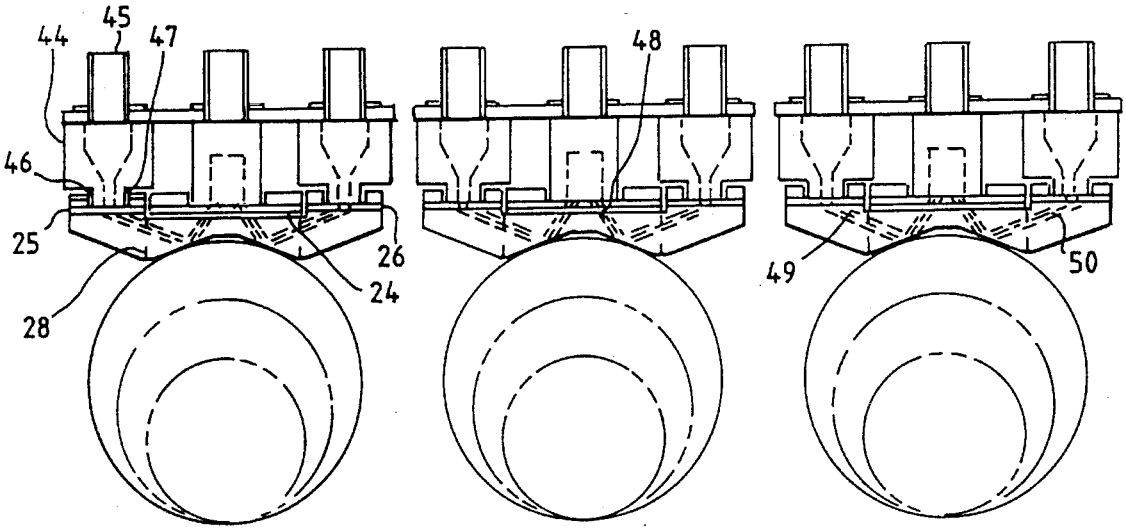
FIG. 6 is a view similar to FIGS. 4 and 5 and showing details of the roll suspension system.

As can be appreciated from FIG. 6, each lane is equipped with its own vacuum box 44. One of these is shown fragmentarily in FIG. 3 and is seen to be equipped with a port 45 for coupling the vacuum box to a source of vacuum such as a blower (not shown).

Returning to FIG. 6, it will be noted that the belt systems 24 and 25, 26 each has the center portion of each tooth removed. This allows for a sidewall 46, 47 to fit closely to the belt and prevent loss of vacuum. These advantageously may be non-metalic for eliminating wear.

Vacuum Pads

The pad 27 of the first belt system 24 is equipped with vacuum channels 48 (see FIG. 6). Each pad 28 of the second belt systems 25, 26 is equipped with vacuum channels as at 49 and 50, respectively.

In the illustration given, a 22" long pad (see FIG. 3) is provided with notches 51 cut 90% deep so that each belt can turn corners. The notches are preferred to be sufficiently wide so that paper tails are not pinched. By providing a continuous pad with notches rather than segments, the continuous pad and its separate section is more durable. The inner end of each belt is equipped with teeth 52 and vacuum holes are provided between each of the teeth. These holes as at 53 (see FIG. 5) are generally vertical for the first belt system 24. In contrast, the holes 54 and 55 (see the left hand portion of FIG. 5) are slightly angled relative to the horizontal so as to communicate the horizontally spaced apart belt openings with the top of the roll R. It will be understood that the belt 24 has no vacuum openings therein other than in the portion carrying the pad 27—so no vacuum could be applied to pad 28.

Summary of Operation

According to the invention, the rolls are transported over a cull area by means of two independent timed systems, preferably belts. In the illustration given, a vacuum type suspension system is used in place of the previously employed finger conveyor. Vacuum holes are randomly spaced in a pad section 27, 28 which is contoured to conform to the top of the roll—see the upper central section of FIG. 6. Each belt system 24 or 25, 26 is then positioned such that the distance between respective vacuum hole areas (the part where no vacuum exists) matches the distance between the final roll $R_U$ of a first log and the first roll $R_D$ on a following log. This will cause the two trim annuli in the non-vacuum area to fall into the cull area while the rolls are carried over the cull area by vacuum. As log lengths and roll position in a log change (due to cutoff length changes), the two vacuum belt systems are rephrased relative to each other and to the logs in order to quickly and easily respond to production changes. This rephasing is done either manually or automatically.

Based on space requirements, the vacuum sections on each belt system may be positioned so close to each other that an area of non-vacuum belt will be formed opposite the area on the belt where the trim annuli are positioned. Due to this, pivoting rails as at 15*a* are located over the cull area 16 but underneath the rolls to support the rolls while this section of belt passes by. During this time the log pusher 17 will continue to convey the rolls forward.

To supply a vacuum source, the holes in the timed belts will pass by a vacuum chamber that can be, if desired, turned off and on based upon the presence of a roll in that lane of the saw. In some instances, it will be appreciated, only two or even one log may be advanced rather than utilizing all three lanes.

The invention finds particularly application to continuous motion saws, viz., saws that advance with the log so that there is no interruption of the continuous advance of the log. However, the invention is also applicable to indexing type saws—where the mover is intermittently advanced. On such saws the motion if more violent so greater vacuum may be required.

The invention also deals with another aspect of continuous motion saws and this has to do with the combination of the turn-around of the pusher mechanisms 17. As each mechanism 17 sweeps around its drive pulley as at 30 (see the lower right hand portion of FIG. 2) and after the rolls it is pushing are controlled by the vacuum belt 24, it must not recontact the rolls which would thereby disturb them. To prevent this, as soon as the vacuum belt 24 has control of the rolls including $R_U$, it begins to accelerate the rolls away from the pusher 17 and away from the trim $A_U$ until enough clearance is obtained. Then after that vacuum belt 24 releases the rolls it is transporting, the belt 24 decelerates and returns to the original distance relationship it had with the second belt system 25, 26.

Among the benefits and advantages of the invention is a higher speed potential due to reduced mass and mechanical simplicity of the roll suspension systems. It yields 100% removal of trim annuli without the use of fingers and reduces maintenance due to the few moving parts and lack of mechanically reciprocating motions.

While in the foregoing specification a detailed description of an embodiment of the invention has been set down for the purpose of illustration, many variations in the details hereingiven may be made by those skilled in the art without departing from the spirit and scope of the invention.

I claim:

1. Apparatus for handling rolls and trim annuli resulting from transversely severing a series of logs of convolutely wound web material, each log having an upstream end and a downstream end and including an upstream roll and a downstream roll, comprising a frame, trough means on said frame defining a horizontal path with said trough means and said path each also having upstream and downstream ends for supporting each of said logs and said rolls, pusher means operably associated with said trough means for engaging the upstream end of each log to advance said log toward the downstream end of said path, blade means movably mounted on said frame for transversely severing each log into a plurality of retail-size rolls and upstream and downstream trim annuli, said trough means adjacent its downstream end being equipped with means for opening said trough means to remove support from said retail-size rolls and trim annuli, said opening means having a horizontal length sufficient to allow a trim annulus to fall through said trough means, and first means mounted on said frame above said opening means for suspending at least a first log upstream roll and second means above said opening for suspending at least a following log downstream roll independently of said first log upstream roll, neither of said first and second means being operative to suspend said trim annuli whereby said trim annuli are adapted to fall out of said path.

2. The apparatus of claim 1 in which said pusher means are adapted to advance at a predetermined speed, said opening means horizontal length being sufficient to allow annuli traveling at said predetermined speed to fall through said trough means.

3. The apparatus of claim 1 in which control means are operably associated with said frame for changing the relative positions of said first and second suspending means.

4. The apparatus of claim 3 in which each of said first and second suspending means include first and second vacuum pad means.

5. The apparatus of claim 1 in which control means are operably associated with said frame for changing the position of said first and second suspending means relative to said pusher means.

6. The apparatus of claim 1 in which said trough means includes side-by-side rails, said opening means including a relatively elongated rail section pivotally mounted on said frame and means on said frame for transversely pivoting said rail section.

7. The apparatus of claim 1 in which said opening means horizontal length is sufficient to span at least one cut roll length.

8. The apparatus of claim 1 in which an open-bottomed chamber is mounted on said frame above said opening means, vacuum applying means operably associated with said frame coupled to said chamber, and first and second continuous elongated belts each having a lower run substantially closing said chamber bottom, each of said belts having a foraminous pad, said first belt pad being arranged to contact the upstream roll of the first log and said second belt pad being arranged to contact the downstream roll of the following log and means for moving said belts.

9. The apparatus of claim 8 in which said frame is equipped with means for temporarily increasing the velocity of movement of said first belt.

10. The apparatus of claim 8 in which each belt pad extends only partway of the length of the belt.

11. The apparatus of claim 8 in which said frame is equipped with a vertically movable subframe, said chamber and belts being mounted on said subframe and means on said subframe for moving said subframe vertically to position said pads for engaging rolls of different diameter.

12. The apparatus of claim 1 in which said first and second suspending means includes first and second elongated vacuum belt means, said pusher means including a plurality of equally spaced apart pushers the length of each belt means being the same as the distance between adjacent pushers.

13. Apparatus for handling rolls and trim annuli resulting from transversely severing a series of logs of convolutely wound web material, each log having an upstream end and a downstream end and including an upstream roll and a downstream roll, comprising a frame, trough means on said frame defining a horizontal path with said trough means and said path each also having upstream and downstream ends for supporting each of said logs and said rolls, pusher means operably associated with said trough means for engaging the upstream end of each log to advance said log toward the downstream end of said path, blade means movably mounted on said frame for transversely severing each log into a plurality of retail-size rolls and upstream and downstream trim annuli, said trough means adjacent its downstream end being equipped with means for opening said trough means to remove support from said retail-size rolls and trim annuli, and first means mounted on said frame above said opening means for suspending a first log upstream roll and second means above said opening for suspending a following log downstream roll independently of said first log upstream roll, neither of said first and second means being operative to suspend said trim annuli whereby said trim annuli are adapted to fall out of said path, each of said suspending means including an elongated continuous belt having a lower run above said opening means, each belt having a foraminous pad extending only partway of the length of the belt, an open bottomed vacuum chamber above said lower runs operative to apply a roll suspending vacuum to said foraminous pads.

14. The apparatus of claim 13 in which each pad has a transverse contour generally shaped to a periphery of each of said rolls.

* * * * *